United States Patent [19]

Yabuta et al.

[11] 4,387,150

[45] Jun. 7, 1983

[54] FIXABLE THERMOSENSITIVE RECORDING SHEET

[75] Inventors: Kenji Yabuta, Funabashi; Senji Tosa, Tokyo; Akira Tanaka, Chudojikitamachi, all of Japan

[73] Assignee: Mitsubishi Paper Mills, Ltd., Tokyo, Japan

[21] Appl. No.: 294,553

[22] Filed: Aug. 20, 1981

[30] Foreign Application Priority Data

Sep. 1, 1980 [JP] Japan ..... 55-120891

[51] Int. Cl.[3] ..... G03C 1/60

[52] U.S. Cl. ..... 430/162; 430/151; 430/179; 430/346; 430/541

[58] Field of Search ..... 430/151, 162, 179, 346, 430/541

[56] References Cited

U.S. PATENT DOCUMENTS

| | | | |
|---|---|---|---|
| 3,389,995 | 6/1968 | Tripp | 430/151 |
| 3,493,374 | 2/1970 | Ronckel et al. | 430/179 |
| 3,642,483 | 2/1972 | Kubo et al. | 430/179 |

FOREIGN PATENT DOCUMENTS

| | | | |
|---|---|---|---|
| 1376709 | 9/1964 | France | 430/151 |
| 39-08141 | 5/1964 | Japan | 430/151 |
| 51-1113 | 1/1976 | Japan | 430/541 |
| 907724 | 2/1960 | United Kingdom | 430/151 |
| 1128762 | 10/1968 | United Kingdom | 430/151 |

*Primary Examiner*—Charles L. Bowers

*Attorney, Agent, or Firm*—Cushman, Darby & Cushman

[57] ABSTRACT

A fixable thermosensitive recording sheet with excellent shelf life and high developed color density is obtained by using a hydrophobic guanidine derivative as heat-fusible developer in a thermosensitive recording sheet consisting of a substrate, a photo- and thermo-sensitive layer made from a diazonium salt and formed on said substrate, and a developer layer overlying said photo- and thermo-sensitive layer and made from a heat-fusible developer, with a coupler compound contained in at least one of said two layers.

8 Claims, No Drawings

FIXABLE THERMOSENSITIVE RECORDING SHEET

BACKGROUND OF THE INVENTION

1. Field of the Invention

This invention relates to a fixable thermosensitive recording sheet, and more particularly it relates to a fixable thermosensitive recording sheet which has excellent shelf life before use for thermal recording and can develop color to a high density by thermal recording.

2. Description of the Prior Art

The recent years have seen amazing development in the field of information processing means such as high-speed printer, facsimile, etc., to meet the request of the society for outputting a vast volume of information as hard copies at as high speed as possible. A variety of techniques such as electrophotographing, electrostatic recording, electrosensitive recording, ink jet recording and thermosensitive recording are known as means for forming images on a recording medium according to the electric information in said information processing machines. Among these techniques, thermosensitive recording is rapidly gaining popularity in recent years owing to its relative simplicity of mechanism and relative uncostliness of recording sheet used therefor.

A thermosensitive recording sheet comprising a combination of a color forming material such as crystal violet lactone and a phenolic compound such as bisphenol A, which is used for said thermosensitive recording, is already known from, for example, Japanese Patent Publication No. 14039/1970. Such themosensitive recording sheet is widely used as copying paper for business matters and as recording paper for a variety of devices such as various types of recorders, electrocardiograph, desk computers, computer terminals, facsimile, etc.

These conventional means, however, involved the possibility that the printed letters could become illegible as a result of mistaken heating after printing to form color on the background or that the printed letters might be falsified, and thus the improvements on these matters have been strongly desired.

A thermo- and photo-sensitive material composed of a substance producing an alkali by thermal decomposition, a diazonium salt forming color with the alkali and a coupler compound, all layered on a substrate and, if necessary, further added with a binder, an acid stabilizer and/or other additives, is known as a diazo type sensitive material for thermal development. This diazo type sensitive material is advantageous in that it produces no irritant gas, as the development can be accomplished with heat alone, with no need of using ammonia gas which is used in the conventional dry type diazo method. Various types of color developers usable for such diazo type sensitive material have already been disclosed, and as typical developer compounds, there are known the inorganic or organic ammonium salts, urea or its derivatives, and salts obtained from neutralization with basic materials such as triethanolamine and heat-decomposable acids such as trichloroacetic acid. However, speed-up of such thermosensitive recording system, particularly elevation of the recording speed is desired lately, and it is required to create a sufficient color density with small heat energy.

In the method using a material, such as said above, which produces an alkali by thermal decomposition, it needs to use a material having a low thermal decomposition temperature for improving recording sensitivity. But, since such material undergoes thermal decomposition even at normal temperature, there may occur "precoupling" due to natural decomposition of the developer before development, resulting in thermal fogging and poor shelf life. On the other hand, use of a material with high thermal decomposition temperature for the improvement of shelf life may lead to an excess drop of color density as the thermosensitive recording speed is increased. In order to overcome such defects, in the field of copying sheet using a diazo type sensitive material for thermal development, it has been prepared to use as developer (heat-fusible developer) the fusible base particles which are theremally fused to produce an alkaline atmosphere, and as examples of such developer compounds, the aliphatic or alicyclic mono- or polyamines such as octadecylamine, hexadecylamine, decamethyleneamine, etc., are proposed in, for example, Japanese Patent Publication No. 1874/1964. These amines, however, are relatively hydrophilic, so that when a dispersion formed by ball milling and dispersing such compound with water is coated on a substrate after adding a diazonium salt, an azo coupler compound and other additives, the whole coating surface presents a slightly alkaline atmosphere due to said amine compound even under a non-heated condition, and this causes a reaction between the diazonium salt and the azo coupler compound to cause a slight degree of thermal fog to badly affect the shelf life, and further, the developed color density at the time of thermal development is also low. Moreover, when an acidic material is added to a particulate dispersion of the heat-fusible developer for improving the shelf life and the dispersion is coated on a substrate along with a diazonium salt and a coupler compound, there results excessively low density of developed color. There is also known a three-layer coating method in which the heat-fusible developer layer is separated from the diazonium compound-containing layer by interposing an intermediate layer, as for instance shown in Japanese Patent Publication No. 377/1965, for the purpose of improving the shelf life, but this method has the problem of elevated manufacturing cost and is also unable to provide a sufficiently high color density to meet the practical requirements in uses for high-speed thermosensitive recording as contemplated in this invention.

Japanese Patent Publication No. 40455/1976 discloses a diazo type thermally developed copying material obtained by dispersing a guanidine compound such as aminoguanidine, cyanoguanidine or 3-methoxybenzguanidine together with a water-soluble coupling component in a water-soluble sensitive solution composed of a photosensitive diazonium compound and a trichloroacetate (developer), then applying this dispersion on a substrate and drying same. But the guanidine compound used there is utterly different from the guanidine compound of this invention in both properties and function, particularly in that the former is soluble in water and that it is used as a material (eutectic material) for improving the coupling reaction rate (color developing rate) during thermal development by taking advantage of the fact that this material lowers the melting point of the water-soluble coupling component.

SUMMARY OF THE INVENTION

This invention has for its object to provide a thermosensitive recording sheet which is free of the said defects of the prior products, has excellent shelf life, can produce a high developed color density and is also fixable.

According to this invention, there is provided a fixable thermosensitive recording sheet consisting of a substrate, a photo- and heat-sensitive layer composed of an acid stabilized diazonium salt capable of forming a dye by reacting with a coupler compound, and a heat-softening binder material, said layer being formed on said substrate, and a developer layer composed of a heat-softening binder material and a particulate dispersion of a heat-fusible developer capable of supplying a necessary amount of base for effecting sufficient reaction of said acid stabilized diazonium salt with the coupler compound, said developer layer overlying said photo- and heat-sensitive layer, said coupler compound being contained in at least one of said two layers, and said heat-fusible developer being represented by the following general formula:

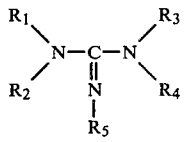

(wherein one or both of $R_1$ and $R_2$ is/are selected from the group consisting of alkyl, cycloalkyl, aryl and aralkyl groups, and when only one of $R_1$ and $R_2$ is selected from said groups, the remaining $R_1$ or $R_2$ is hydrogen; one or both of $R_3$ and $R_4$ is/are selected from the group consisting of alkyl, cycloalkyl, aryl and aralkyl groups, and when only one of $R_3$ and $R_4$ is selected from said groups, the remaining $R_3$ or $R_4$ is hydrogen; and $R_5$ is selected from the group consisting of alkyl, cycloalkyl, aryl and aralkyl groups, and wherein said cycloalkyl group may have a halogen substituent and said aryl group may have a substituent selected from the group consisting of alkyl, alkoxy, nitro and halogen).

DETAILED DESCRIPTION OF THE INVENTION

The heat-fusible developer used for the thermo-sensitive recording sheet according to this invention is a hydrophobic guanidine derivative represented by the above-shown general formula.

The selection of a hydrophobic guanidine derivative for the developer in this invention is based on the following reason: if the guanidine compound used is hydrophilic, the resulting product proves to be very poor in shelf life because of promoted thermal fog in a non-heated condition as in the case of the amine compounds disclosed in aforementioned Japanese Patent Publication No. 1874/1964, and also the obtained thermo-sensitive recording sheet having a hydrophilic guanidine compound-containing layer on a substrate, if left in the air, absorbs moisture in the air to cause gradual color development in the base density, whereas if the guanidine compound is hydrophobic, thermal fog in a non-heated state is limited, and also even during heat development, the guanidine compound is fused only at the heated portion to create an alkaline atmosphere to initiate a reaction between the diazonium salt and the azo coupler compound, thereby elevating the developed color density, and further the obtained recording sheet, if left in the air, scarcely absorbs moisture in the air to cause substantially no development of color in the base density.

The hydrophobic guanidine derivative used in this invention is preferably of the type having a solubility of 2 g or less in one liter of water. It is also desirable that said hydrophobic guanidine derivative is such as represented by the above-shown general formula wherein one of $R_1$ and $R_2$, one of $R_3$ and $R_4$, and $R_5$ are a phenyl group which may have a substituent selected from the group consisting of alkyl, alkoxy, nitro and halogen or a cycloalkyl group which may have a halogen substituent, and remaining $R_1$ or $R_2$ and remaining $R_3$ or $R_4$ are hydrogen.

Shown below by way of structural formulae are some typical examples of the hydrophobic guanidine derivatives represented by the above-shown general formula usable in this invention, but of course the hydrophobic guanidine derivatives usable in this invention are not limited to these examples. In the following structural formulae,

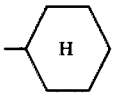

indicates a cyclohexyl group.

(1)

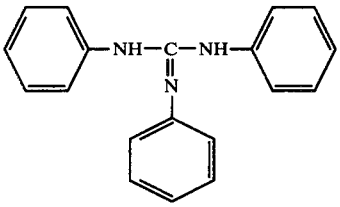

(2)

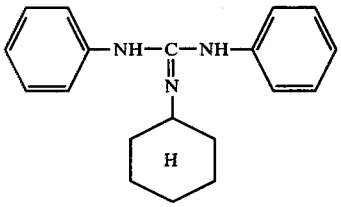

(3)

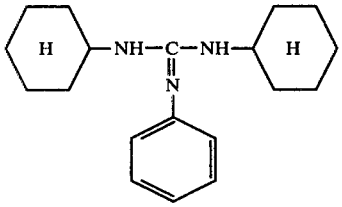

(4)

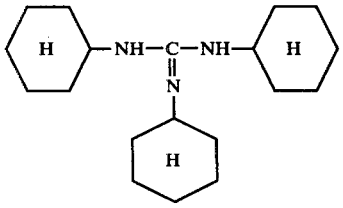

-continued (5)

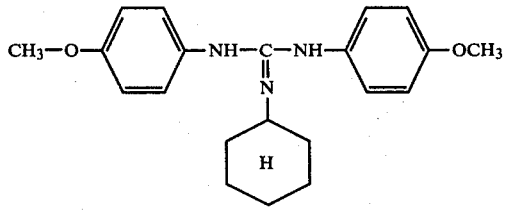

(6)

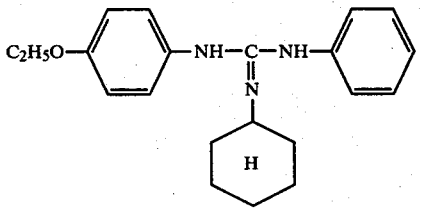

(7)

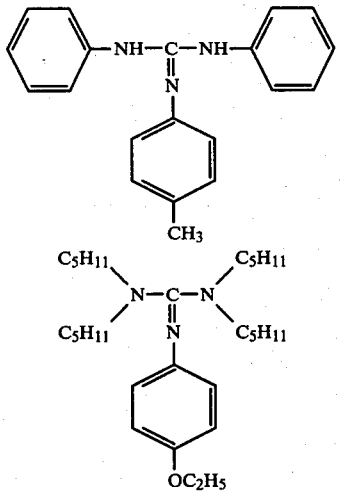

The guanidine derivatives shown above can be easily synthesized by the methods known in the art or the similar methods.

The diazonium salt, coupler compound, heat-softening binder and stabilizer used in this invention may be all suitably selected from those generally used for the ordinary diazo type copying paper. For example, the diazonium salt used in this invention may be optionally selected from those which have been used for the known diazo type copying material, such as 1-diazo-4-N,N-dimethylaminobenzene borofluoride, 1-diazo-4-morpholinobenzenediazonium borofluoride, 4-diazodiphenylamino borofluoride, 1-diazo-2,5-dimethoxy-4-morpholinobenzenediazonium borofluoride and 1-diazo-2,5-diethoxy-4-morpholinobenzene borofluoride. As for the coupler compound usable in this invention, there may be cited the aromatic hydroxy compounds and the compounds having active hydrogen such as, for example, 4-methoxy-1-naphthol, 4-amino-1-naphthol, 1,4-hydroxynaphthalene, 4-ethoxy-1-naphthol, resorcinol, phloroglucin, 2,3-dihydroxynaphthalene-6-sulfonic acid sodium salt, 4-propoxyphenol, acetylacetoamide, and 2-hydroxynaphthalene-3-carboxylic acid ethanolamide. As the heat-softening binder material, one may use the generally known types of water-soluble binders such as polyvinyl alcohol, methyl cellulose, carboxymethyl cellulose, hydroxymethyl cellulose, gum arabic, gelatin, casein, styrene-maleic anhydride copolymer, polyacrylic acid amide, etc., as well as terpene resins and petroleum resins such as cyclized rubber.

As for the stabilizers, there may be optionally used the ordinary diazonium salt stabilizing acids, antioxidants, dye fixing agents, etc.

The thermosensitive recording sheet according to this invention can be obtained roughly in the following way. A coating solution composed principally of a diazonium salt and a heat-softening binder material and added at need with a diazonium salt stabilizing acid, an antioxidant, a printed image strengthening agent and/or the like is applied on a substrate to form a photo- and heat-sensitive layer, and this photo- and heat-sensitive layer is further coated with a coating solution composed principally of a particulate dispersion of a hydrophobic guanidine derivative represented by the above-shown general formula and a heat-softening binder material and mixed at need with other additives such as a melting point depressant to form a developer layer.

The thermosensitive recording sheet consisting of said photo- and heat-sensitive layer and developer layer has a coupler compound contained in at least one of said two layers. Containment of said coupler compound in the developer layer may be accomplished by adding the coupler compound together with a guanidine derivative in the course of preparation of a particulate dispersion of the guanidine derivative which comprises pulverizing said guanidine derivative to a size of several microns or less by a suitable pulverizer such as a ball mill and dispersing it in a binder material of a proper concentration. Or a particulate dispersion of a coupler compound may be first prepared and then added to a particulate dispersion of said guanidine derivative. Or a non-dispersed coupler compound itself may be first added to a particulate dispersion of said guanidine derivative and then dispersed.

In case of containing said coupler compound in the photo- and heat-sensitive layer, such can be effected by adding the coupler compound itself or a particulate dispersion thereof in the diazonium salt and heat-softening binder mixture constituting the photo- and heat-sensitive layer.

Exemplary of the melting point depressant usable in this invention are animal waxes, vegetable waxes, petroleum waxes, polyhydric alcohol esters of higher fatty acids, higher ketones, higher amines, higher fatty acid amides, higher fatty acid-amine condensates, synthetic paraffin and paraffin chloride. These substances may be used in combination of two or more of them. Also, they may be used in the form of fine powder or an emulsion.

Paper is usually used as substrate, but it is also possible to use synthetic resin, film, laminated paper, woven fabric sheet or the like.

The present invention is described in further detail hereinbelow by way of the working and comparative examples thereof.

SYNTHESIS EXAMPLE (1) Synthesis of S-methyl-N,N'-diphenylisothiourea

To a 2 l flask were added 342 g of thiocarbanilide, 240 g of methyl iodide and 350 cc of ethanol and the mixture was refluxed for 2 hours. After cooling the mixture to a room temperature, a small amount of water was added and the mixture was allowed to stand to precipitate the raw product, which was then filtered off and dissolved in 12 l of hot water. After filtration, the filtrate was converted to an alkaline solution by addition of NaOH to precipitate the product. The product was filtered and washed well until the filtrate became neutral. After drying, the product was recrystalized in 1 l of ethanol to give S-methyl-N,N'-diphenylisothiourea.

Yield 282 g (77.6%)
m.p. 105°–106° C.

(2) Synthesis of 1,3-diphenyl-2-p-tolylguanidine (afore-shown compound (7))

To a 2 l flask were added 193 g of S-methyl-N,N'-diphenylisotiourea obtained above, 90 g of p-toluidine and 240 cc of xylene and the mixture was refluxed for 30 hours. After cooling the mixture to a room temperature, it was kneaded with 500 cc of petroleum ether and cooled with ice to crystalize the product, which was then filtered off, recrystalized from 2 l of ligroin and dried to obtain 1,3-diphenyl-p-tolylguanidine (the compound (7)).

Yield 161 g
m.p. 121°–122° C.

COMPARATIVE EXAMPLE 1

A coating solution for a photo- and thermo-sensitive layer is prepared according to the following recipe, and this solution is coated on a substrate to provide a coating weight of 6.0 g/m$^2$ after drying.

Recipe

| | |
|---|---|
| Citric acid | 2 g |
| Thiourea | 2 g |
| Sulfosalicylic acid | 3 g |
| Zinc chloride | 4 g |
| 2,3-dihydroxynaphthalene-6-sulfonic acid sodium salt | 2 g |
| 4-diazo-N,N'—dimethylaniline (zinc chloride salt) | 1.5 g |
| 10% gum arabic | 30 g |
| Water | 100 ml |

Then a coating solution for a developer layer prepared according to the following recipe is coated on said photo- and thermo-sensitive layer so as to provide a coating weight of 7.5 g/m$^2$ after drying, thereby forming a thermosensitive recording paper.

Coating solution for developer layer

| | |
|---|---|
| Solution A | 10 g |
| 10% aqueous solution of gum arabic | 12 g |

Solution A was prepared by ball milling for 24 hours a composition of the following recipe:

| | |
|---|---|
| Stearylamine | 7 g |
| Stearic acid amide | 3 g |
| 10% aqueous solution of gum arabic | 7 g |
| Water | 20 g |

EXAMPLE 1

A thermosensitive recording paper is produced in the same way as Comparative Example 1 except that 1,3-diphenyl-2-cyclohexylguanidine (afore-shown compound (2)), 1,3-dicyclohexyl-2-phenylguanidine (compound (3)), 1,2,3-tricyclohexylguanidine (compound (4)), 1,3-di-p-methoxyphenyl-2-cyclohexylguanidine (compound (5)), 1-phenyl-3-p-ethoxyphenyl-2-cyclohexylguanidine (compound (6)), 1,3-diphenyl-2-p-tolylguanidine (compound (7)) or 1,1,3,3-tetra-n-pentyl-2-p-ethoxy-phenylguanidine (compound (8)) is used instead of stearylamine in Solution A of Comparative Example 1.

COMPARATIVE EXAMPLE 2

A thermosensitive recording paper is made in the same way as Comparative Example 1 except for use of 1,3-diphenylguanidine instead of stearylamine in Solution A of Comparative Example 1.

EXAMPLE 2

A coating solution for a photo- and thermo-sensitive layer is prepared according to the following recipe, and this solution is coated on a substrate to provide a coating weight of 6.5 g/m$^2$ after drying.

Recipe

| | |
|---|---|
| Tartaric acid | 2 g |
| Ethylthiourea | 2 g |
| Sulfosalicylic acid | 3 g |
| Zinc chloride | 3 g |
| 4-diazo-2,5-diethoxy-morpholino-benzene borofluoride | 2 g |
| 10% aqueous solution of gum arabic | 20 g |
| Water | 100 ml |

Then a coating solution for a developer layer prepared according to the following recipe is coated on said photo- and thermo-sensitive layer so as to provide a dry coating weight of 8.0 g/m$^2$, thereby forming a thermosensitive recording paper.

Recipe of the coating solution for developer layer

| | |
|---|---|
| Solution B | 4 g |
| Solution C | 2 g |
| Cellosol #2M (stearic acid amide emulsion, product by Chukyo Yushi) | 3 g (solids) |
| 10% aqueous solution of gum arabic | 12 g |

Solution B was prepared from 24-hour ball milling of a composition of the following blend:

| | |
|---|---|
| 1,2,3-triphenylguanidine (compound (1)) | 10 g |
| 10% aqueous solution of gum arabic | 6 g |
| Water | 25 ml |

Solution C was prepared by similarly treating a composition of the following blend:

| | |
|---|---|
| 2-hydroxynaphthalene-3-carboxylic acid ethanolamide | 10 g |
| 10% aqueous solution of gum arabic | 6 g |
| Water | 25 ml |

COMPARATIVE EXAMPLE 3

A thermosensitive recording paper is made in the same way as Comparative Example 1 except for use of 2-phenylimidazole instead of stearylamine in Solution A of Comparative Example 1.

These thermosensitive recording papers developed a blue color upon 0.5-second heating on a hot plate of 120° C., and after this thermal color formation, they were fixed by ultraviolet light exposure.

After fixing, fog density and developed color density of each thermosensitive recording paper were measured by a densitometer (manufactured by Tokyo Koden KK). The results are shown in Table 1 below.

TABLE 1

| | Fog density | | Developed |
|---|---|---|---|
| | Just after coating | One week after coating | color density 120° C., 0.5 sec. |
| Example 1 Compound (2) | 0.12 | 0.13 | 1.07 |
| Example 1 Compound (3) | 0.12 | 0.13 | 1.10 |
| Example 1 Compound (4) | 0.13 | 0.15 | 1.09 |
| Example 1 Compound (5) | 0.11 | 0.12 | 1.03 |
| Example 1 Compound (6) | 0.10 | 0.11 | 1.02 |
| Example 1 Compound (7) | 0.12 | 0.13 | 1.01 |
| Example 1 Compound (8) | 0.13 | 0.15 | 1.10 |
| Example 2 Compound (1) | 0.12 | 0.13 | 1.05 |
| Comparative Example 1 | 0.26 | 0.28 | 0.28 |
| Comparative Example 2 | 0.24 | 0.35 | 0.98 |
| Comparative Example 3 | 0.24 | 0.25 | 0.26 |

As described above, fixable thermosensitive recording sheet with excellent shelf life and high developed color density could be obtained by using a hydrophobic guanidine derivative according to this invention as the heat-fusible developer.

It is to be noted that Compound (3) had especially excellent properties to provide an outstanding high developed color density and low fog density.

What is claimed is:

1. A fixable thermosensitive recording sheet consisting of a substrate, a photo- and thermo-sensitive layer composed of an acid stabilized diazonium salt capable of forming a dye by reacting with a coupler compound, and a heat-softening binder material, said layer being formed on said substrate, and a developer layer composed of a heat-softening binder material and a particulate dispersion of a heat-fusible developer capable of supplying a necessary amount of base for allowing said acid stabilized diazonium salt to react sufficiently with the coupler compound, said developer layer being formed on said photo- and thermo-sensitive layer, wherein the coupler compound is contained in at least one of said two layers and the heat-fusible developer is a hydrophobic guanidine derivative represented by the general formula:

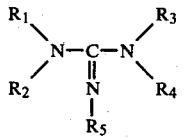

wherein one or both of $R_1$ and $R_2$ is/are selected from the group consisting of alkyl, cycloalkyl, aryl and aralkyl groups, and when only one of $R_1$ and $R_2$ is selected from said groups, the remaining $R_1$ or $R_2$ is hydrogen; one or both of $R_3$ and $R_4$ is/are selected from the group consisting of alkyl, cycloalkyl, aryl and aralkyl groups, and when only one of $R_3$ and $R_4$ is selected from said groups, the remaining $R_3$ or $R_4$ is hydrogen; and $R_5$ is selected from the group consisting of alkyl, cycloalkyl, aryl and aralkyl groups, wherein said cycloalkyl group may have a halogen substituent and said aryl group may have a substituent selected from the group consisting of alkyl, alkoxy, nitro and halogen.

2. The fixable thermosensitive recording sheet according to claim 1, wherein said hydrophobic guanidine derivative has a solubility of 2 g or less in one liter of water.

3. The fixable thermosensitive recording sheet according to claim 1, wherein said hydrophobic guanidine derivative is of the above-shown general formula wherein one of $R_1$ and $R_2$, one of $R_3$ and $R_4$, and $R_5$ are a phenyl group which may have a substituent selected from the group consisting of alkyl, alkoxy, nitro and halogen, or a cycloalkyl group which may have a halogen substituent, and the remaining $R_1$ or $R_2$ and remaining $R_3$ or $R_4$ are hydrogen.

4. The fixable thermosensitive recording sheet according to claim 3, wherein said hydrophobic guanidine derivative is a compound of the formula:

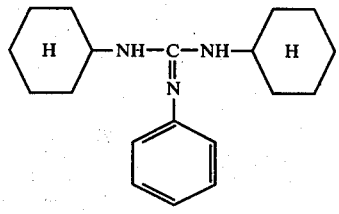

5. The fixable thermosensitive recording sheet according to claim 3, wherein said hydrophobic guanidine is a compound of the formula:

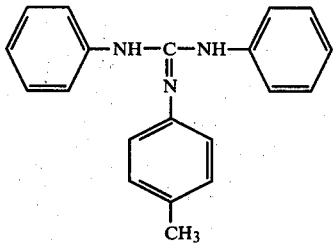

6. The fixable thermosensitive recording sheet according to claim 1, wherein said hydrophobic guanidine derivative is of the above-shown general formula wherein $R_1$, $R_2$, $R_3$ and $R_4$ are each an alkyl group having 4 to 7 carbon atoms, and $R_5$ is a phenyl group which may have a substituent selected from the group consisting of alkyl, alkoxy, nitro and halogen or a cycloalkyl group which may have a halogen substituent.

7. The fixable thermosensitive recording sheet according to claim 6, wherein said hydrophobic guanidine derivative is a compound of the formula:

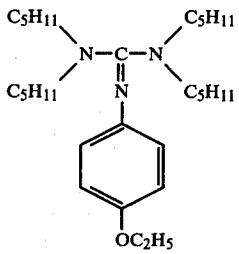

8. The fixable thermosetting recording sheet according to claim 1 wherein said hydrophobic guanidine derivative is
(1)
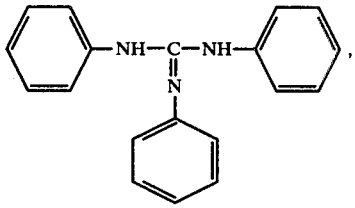
(2)
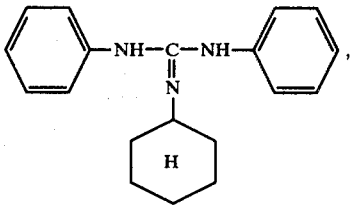
(3)
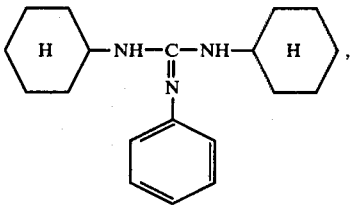
(4)
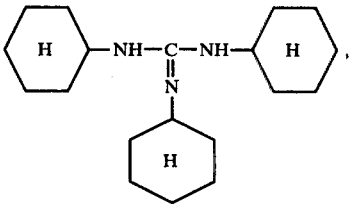
-continued
(5)
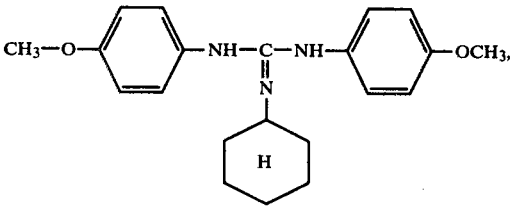
(6)
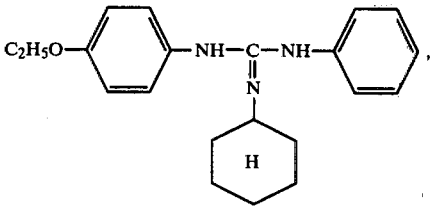
(7)
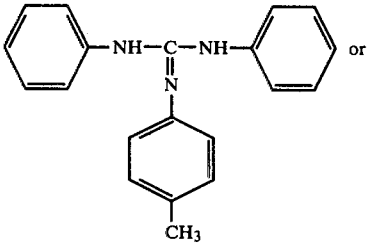
(8)
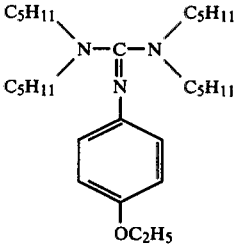
* * * * *